US010370926B2

(12) United States Patent
Al-Badran

(10) Patent No.: US 10,370,926 B2
(45) Date of Patent: Aug. 6, 2019

(54) APPARATUS AND METHOD TO CONTAIN FLANGE, PIPE AND VALVE LEAKS

(71) Applicant: Saudi Arabian Oil Company, Dhahran (SA)

(72) Inventor: Mohammad Saud Al-Badran, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 15/015,615

(22) Filed: Feb. 4, 2016

(65) Prior Publication Data

US 2016/0153258 A1 Jun. 2, 2016

Related U.S. Application Data

(63) Continuation-in-part of application No. 14/499,833, filed on Sep. 29, 2014.

(51) Int. Cl.
*E21B 33/06* (2006.01)

(52) U.S. Cl.
CPC ..... *E21B 33/061* (2013.01)

(58) Field of Classification Search
CPC .... E21B 33/0385; E21B 33/06; E21B 33/061; E21B 33/062
USPC ..... 251/1.2
See application file for complete search history.

(56) References Cited

U.S. PATENT DOCUMENTS 1,565,718 A * 12/1925 Dorman ..... E21B 33/06 138/46
3,554,480 A 1/1971 Rowe et al.
4,171,142 A 10/1979 Harrison
6,244,336 B1 6/2001 Kachich
6,877,712 B2 * 4/2005 Wiedemann ..... E21B 33/062 251/1.3
7,051,989 B2 5/2006 Springett et al.
7,243,713 B2 7/2007 Isaacks et al.
8,662,183 B1 3/2014 Vickio, Jr.
2004/0108010 A1 6/2004 Gaston et al.
(Continued)

FOREIGN PATENT DOCUMENTS

CN 201779401 U 3/2011
CN 103866065 A 6/2014
JP 54109624 A 8/1979

OTHER PUBLICATIONS

International Search Report and Written Opinion for related PCT application PCT/US2015/052590 dated Jan. 22, 2016.
(Continued)

*Primary Examiner* — Nicole Coy
*Assistant Examiner* — Brandon M Duck
(74) *Attorney, Agent, or Firm* — Bracewell LLP; Constance G. Rhebergen; Linda L. Morgan

(57) ABSTRACT

A system and method for sealing around a fluid flow member includes a ram closing assembly. The ram closing assembly has a sealing chamber having a generally cylindrical shape when the ram closing assembly is in a closed position. A ram assembly is located at an end of the sealing chamber. The ram assembly has a pair of rams, each ram having an engaging surface, the engaging surface sized and shaped to seal around the fluid flow member. The ram assembly also has an actuating arm assembly connected to one of the rams and a ram body. The pair of rams is rotationally attached to the ram body.

16 Claims, 2 Drawing Sheets

(56) References Cited

U.S. PATENT DOCUMENTS

| | | | | |
|---|---|---|---|---|
| 2010/0051847 | A1 | 3/2010 | Mailand et al. | |
| 2011/0030943 | A1 | 2/2011 | Le et al. | |
| 2012/0073815 | A1 | 3/2012 | Springett et al. | |
| 2012/0216901 | A1* | 8/2012 | Dickinson | F16L 55/1715 138/99 |
| 2013/0126030 | A1 | 5/2013 | Green | |
| 2013/0153241 | A1 | 6/2013 | Mallinson et al. | |
| 2014/0209320 | A1* | 7/2014 | Le | E21B 33/062 166/373 |
| 2015/0300106 | A1* | 10/2015 | Martin | E21B 33/068 166/382 |

OTHER PUBLICATIONS

The International Search Report and Written Opinion for related PCT application PCT/US2017/016158 dated Apr. 12, 2017.

* cited by examiner

APPARATUS AND METHOD TO CONTAIN FLANGE, PIPE AND VALVE LEAKS

CROSS REFERENCE TO RELATED APPLICATIONS

This application is a continuation in part of co-pending U.S. application Ser. No. 14/499,833, titled "Scissor-Mechanism Closing Rams of Blow Out Preventors," filed Sep. 29, 2014, the disclosure of which is incorporated herein by reference in its entirety.

BACKGROUND OF THE DISCLOSURE

1. Field of the Disclosure

The present disclosure relates generally to fluid flow members carrying fluids for industrial processes, and more particularly to systems and methods for operating rams to contain leaks of the fluid flow members.

2. Description of the Related Art

In many industrial processes, various fluids are delivered by way of pipeline systems. As an example, during hydrocarbon production, development, and distribution operations, hydrocarbons and other fluids flow through pipelines and valve assemblies, at times, at high pressure. When a valve, pipe, flange, or other component of the fluid flow system leaks, the well or flowline may have to be shut in or the flow rate may have to be reduced until the leak is repaired. This results in costly downtime or reduction of operations until the cause of the leak can be identified and remedied.

SUMMARY OF THE DISCLOSURE

Embodiments of the present disclosure provide systems and methods that can contain the leak and isolate the leak until further repair can be completed safely, with minimum interruption to the flow rate. These systems and methods will isolate the leak so the industrial process can continue until operating conditions are more conducive to shutting down or reducing operations. Embodiments of this disclosure can also allow safe handling of a hydrocarbon well that has experienced a leak, by allowing personnel to get close to the wellhead without getting exposed to the leak discharge.

In an embodiment of this disclosure for sealing around a fluid flow member includes a sealing chamber having a generally cylindrical shape when the ram closing assembly is in a closed position. A ram assembly is located at an end of the sealing chamber. The ram assembly has a pair of rams, each ram having an engaging surface. The engaging surface is sized and shaped to seal around the fluid flow member. An actuating arm assembly of the ram assembly is connected to one of the rams. The ram assembly also has a ram body. The pair of rams is rotationally attached to the ram body.

In alternate embodiments, the ram closing assembly can have a power source operable to move the actuating arm assembly between an extended position and a retracted position. When the actuating arm assembly is in an extended position, the ram closing assembly can be in the closed position, and when the actuating arm assembly is in a retracted position, the ram closing assembly can be in an open position. When the ram closing assembly is in the closed position, the engaging surface can be operable to seal against an operating pressure of the fluid flow member. The engaging surface can be an arc shaped seal and when the ram closing assembly is in the closed position, the engaging surface can seal around an outer circumference of the fluid flow member.

In other alternate embodiments, the sealing chamber can be split longitudinally and one of the rams can be secured to the sealing chamber. The sealing chamber can have chamber seals that seal mating surfaces of the sealing chamber when the ram closing assembly is in the closed position. Alternately, the sealing chamber can be a seamless tubular member. One of the rams can be static relative to the sealing chamber and the other of the ram can rotate relative to the sealing chamber. The ram closing assembly can be a standalone portable unit.

In an alternate embodiment of this disclosure, a ram closing assembly for sealing around a fluid flow member includes a sealing chamber operable to maintain a seal around an outer diameter of the fluid flow member. The fluid flow member has a fluid flow path containing a fluid under pressure. A ram assembly is secured to each end of the sealing chamber. Each ram assembly can have a pair of rams. Each ram has an engaging surface, the engaging surface sized and shaped to seal around the fluid flow member, wherein one of the rams of each ram assembly is connected to the sealing chamber. An actuating arm assembly is connected to one of the rams and is operable to move the ram between a retracted position where the ram closing assembly is in an open position and an extended position where the ram closing assembly is in a closed position. The ram assembly also includes a ram body, the pair of rams being rotationally attached to the ram body.

In alternate embodiments, the ram closing assembly can have a pressurized fluid source operable to move the actuating arm assembly between the extended position and the retracted position. The sealing chamber can have chamber seals that seal against an operating pressure of the fluid flow member. When the ram closing assembly is in the closed position, the engaging surface can be operable to seal against an operating pressure of the fluid flow member. The engaging surface can be an arc shaped seal and when the ram closing assembly is in the closed position, the engaging surface can seal around an outer circumference of the fluid flow member.

In another alternate embodiment of this disclosure, a method for sealing around a fluid flow member with a ram closing assembly includes circumscribing the fluid flow member with a sealing chamber. The sealing chamber has a ram assembly located at an end of the sealing chamber, the ram assembly having a ram body and a pair of rams rotationally attached to the ram body. The pair of rams are actuated with an actuating arm assembly of the ram assembly to move the ram closing assembly to a closed position so that an engaging surface of the rams seal around the fluid flow member. The actuating arm assembly is connected to one of the rams.

In alternate embodiments, the step of actuating the pair of rams with the actuating arm assembly can include moving the actuating arm assembly between an extended position and a retracted position with a power source. The sealing chamber can have chamber seals that seal mating surfaces of the sealing chamber when the ram closing assembly is in the closed position. When the ram closing assembly is in the closed position, the engaging surface can be operable to seal against an operating pressure of the fluid flow member. The engaging surface can be an arc shaped seal and the method can include sealing around an outer circumference of the fluid flow member when the ram closing assembly is in the closed position.

BRIEF DESCRIPTION OF THE DRAWINGS

So that the manner in which the above-recited features, aspects and advantages of the embodiments of this disclosure, as well as others that will become apparent, are attained and can be understood in detail, a more particular description of the disclosure briefly summarized above may be had by reference to the embodiments thereof that are illustrated in the drawings that form a part of this specification. It is to be noted, however, that the appended drawings illustrate only certain embodiments of the disclosure and are, therefore, not to be considered limiting of the disclosure's scope, for the disclosure may admit to other equally effective embodiments.

DETAILED DESCRIPTION OF THE EXEMPLARY EMBODIMENTS

Embodiments of the present disclosure will now be described more fully hereinafter with reference to the accompanying drawings which illustrate embodiments of the disclosure. This disclosure may, however, be embodied in many different forms and should not be construed as limited to the illustrated embodiments set forth herein. Rather, these embodiments are provided so that this disclosure will be thorough and complete, and will fully convey the scope of the disclosure to those skilled in the art. Like numbers refer to like elements throughout, and the prime notation, if used, indicates similar elements in alternative embodiments or positions.

In the following discussion, numerous specific details are set forth to provide a thorough understanding of the present disclosure. However, it will be obvious to those skilled in the art that embodiments of the present disclosure can be practiced without such specific details. Additionally, for the most part, details concerning well drilling, reservoir testing, well completion and the like have been omitted inasmuch as such details are not considered necessary to obtain a complete understanding of the present disclosure, and are considered to be within the skills of persons skilled in the relevant art.

Figure 1:
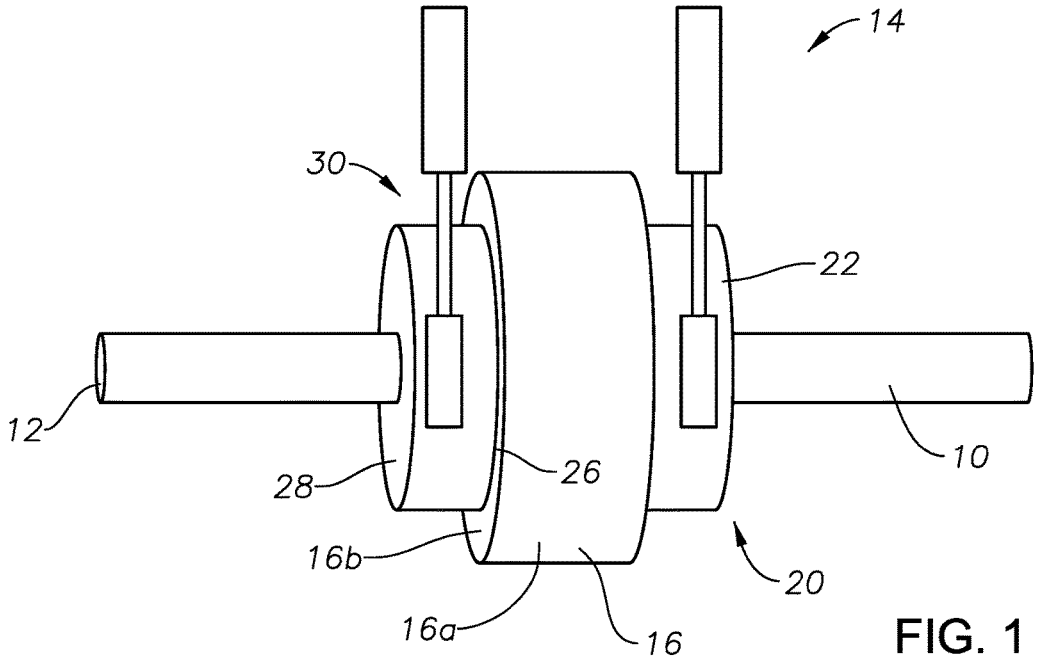
FIG. 1 is a schematic perspective view of a fluid flow member with a ram closing device in accordance with an embodiment of this disclosure, shown with the ram closing device in the closed position.

Referring to FIG. 1, fluid flow member 10 can be a pipeline that can be connected to valve, flange, or other member through which fluid flows. As an example, fluid flow member 10 can be associated with fluids flowing into, or out of, a subterranean well (not shown), such as a well associated with hydrocarbon production operations. Fluid flow member 10 has a fluid flow path 12. When fluid flow member 10 is a pipe, the main central bore of the pipe is the fluid flow path. When fluid flow member 10 is a valve or flange, the fluid flow path 12 can have alternate embodiments, such as a side port, bypass, annulus, or other known fluid path configuration.

Figure 2:
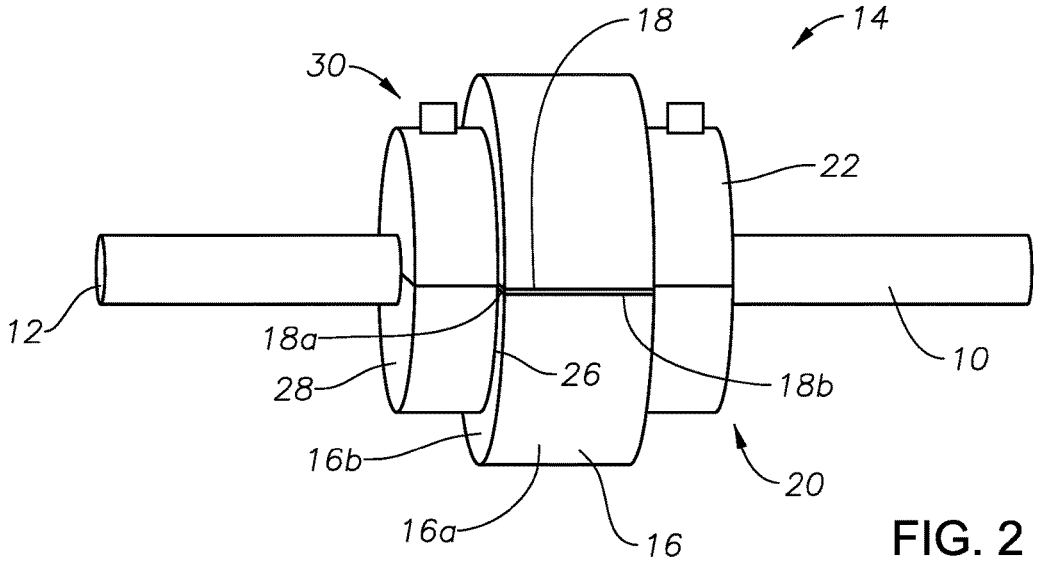
FIG. 2 is another schematic perspective view of the fluid flow member with the ram closing device of claim 1, shown with the ram closing device in the closed position.

Looking at FIGS. 1-2, ram closing assembly 14 is shown in a closed position around a portion of fluid flow member 10. Ram closing assembly 14 can circumscribe fluid flow member 10 at a location of a leak and can provide sufficient sealing against the pressure of the fluid within fluid flow member 10 to maintain the integrity of the industrial operation until the leak can be fixed. As an example, ram closing assembly can contain the fluids within fluid flow member 10 and isolate a portion of fluid flow member 10. Ram closing assembly 14 is a stand-alone portable unit and can be transported from site to site as needed and installed by an operator alone, or with the assistance of a truck or crane.

Ram closing assembly 14 includes sealing chamber 16. Sealing chamber 16 can include an outer surface portion **16*a* and a side portion 16*b*. Sealing chamber 16 can have an outer surface portion that is generally cylindrical in shape when ram closing assembly 14 is in a closed position. As an example, outer surface portion 16*a* of sealing chamber 16 can be a seamless tubular member that is slid over an end of fluid flow member 10. Alternately, sealing chamber 16 can be split longitudinally so that sealing chamber 16 is formed of two or more segments that can seal together around fluid flow member 10. The size of sealing chamber 16 can be selected based on the size of the leaking part of fluid flow member 10. Sealing chamber 16 will selectively have ports (not in the drawing) to sample, inject, or bleed pressure from inside the closed system of fluid flow member 10 and sealing chamber 16**.

Looking at FIG. 2, when sealing chamber 16 is a split member, chamber seals 18 mate when ram closing assembly 14 is in the closed position. Chamber seals 18 can be located along mating surfaces of sealing chamber 16 so that as the segments of sealing chamber 16 come together, sealing chamber 16 can form a sealed body around fluid flow member 10. Chamber seals **18*a* can be located both along mating surfaces of the generally flat side portions of sealing chamber 16 and chamber seals 18*b* can be located along the mating surfaces of the outer curved portion of sealing chamber 16. Chamber seals 18 provide sufficient sealing capabilities to seal against an operating pressure of fluid flow member 10. Chamber seals 18** can withstand high pressures and be H2S resistant.

Figure 3:
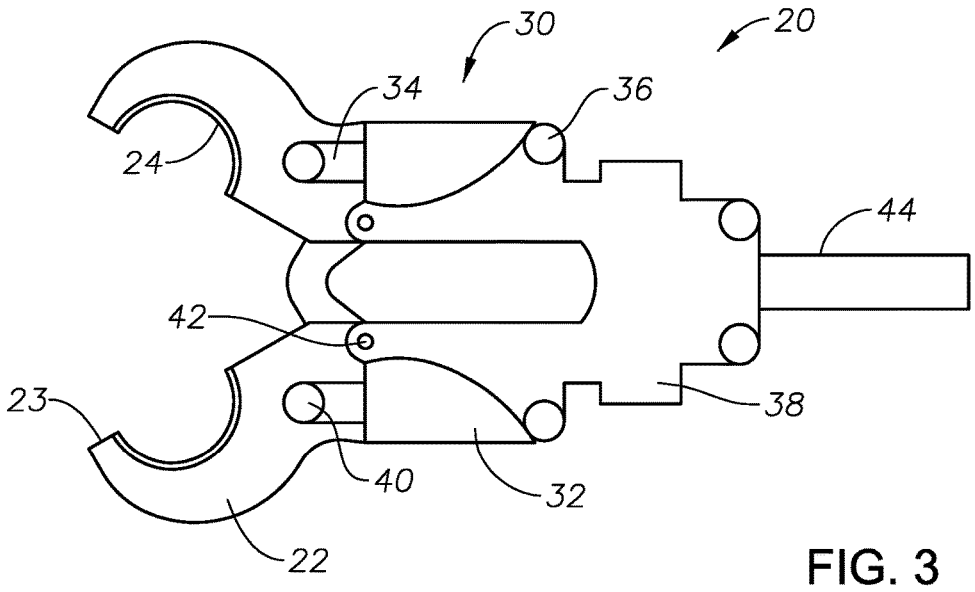
FIG. 3 is a schematic elevation view of the ram closing device of FIG. 1, shown with the rams in the open position.

Ram assembly 20 is located at at least one end of sealing chamber 16. In the embodiments of FIGS. 1-2, a ram assembly 20 is located at each end of sealing chamber 16. In the example embodiment of FIG. 3, ram assembly 20 is shown as oriented when ram closing assembly 14 is in an open position. In the example embodiment of FIG. 4, ram assembly 20 is shown as oriented when ram closing assembly 14 is in the closed position. Ram assembly 20 includes a pair of rams 22. Each ram 22 has engaging surface 24. Engaging surface 24 is sized and shaped to seal around fluid flow member 10. Engaging surface 24 is operable to seal against an operating pressure of fluid flow member 10. Each engaging surface 24 can be an arc shaped seal that engages and seals around an outer circumference of fluid flow member 10 when ram closing assembly 14 is in the closed position.

Each ram 22 can have a general "C" shape with inner surfaces 23 that meet when rams 22 are in a closed position. In the open position, inner surfaces 23 are angled relative to each other. Surface seals 25 can seal between inner surfaces 23 when inner surfaces 23 meet. In alternate embodiments, engaging surface 24 can provide a sufficient seal around fluid flow member 10 so that surface seals 25 are not included. Each ram 22 can have an inner side 26 and an outer side 28. Inner side 26 can be secured to sealing chamber 16. Engaging surface 24 can be located closer to outer side 28 than inner side 26 so that engaging surface 24 can form a seal around fluid flow member 10 without interfering with, or being affected by, the closing of sealing chamber 16.

In embodiments where sealing chamber 16 is a split member, inner side 26 of each ram 22 is secured to sealing chamber 16 so that as each ram 22 moves to seal around fluid flow member 10, a segment of sealing chamber 16 moves with such ram 22. Each ram 22 is secured to a segment of sealing chamber 16 in a manner so that such ram 22 is static relative to such segment of sealing chamber 16 and so that the connection between such ram 22 and such segment of sealing chamber 16 is leak proof. In this way, when ram closing assembly 14 is in the closed position, rams 22, which are fixed to the segments of sealing chamber 16, can maintain sufficient force on chamber seals 18 so that chamber seals 18 can seal against an operating pressure of fluid flow member 10.

In an alternate embodiment, when sealing chamber 16 includes a seamless tubular member, sealing chamber 16 is connected to rams 22. When rams 22 are open, sealing chamber 16 is open to the environment and sealing chamber 16 is closed to the environment when rams 22 are closed. The leak of fluid flow member 10 is isolated at each end by sides by the rams 22 and by chamber seals 18. As an example, one of the rams 22 of each ram assembly 20 can be secured to sealing chamber 16. The ram 22 that is secured to sealing chamber 16 is static relative to sealing chamber 16. The opposing ram 22 that is not secured to sealing chamber 16 moves relative to sealing chamber 16. When rams 22 rotate as ram closing assembly 14 moves to the closed position, inner side 26 of sealing chamber 16 seals against side portion 16*b* of sealing chamber 16 (FIG. 1).

Figure 4:
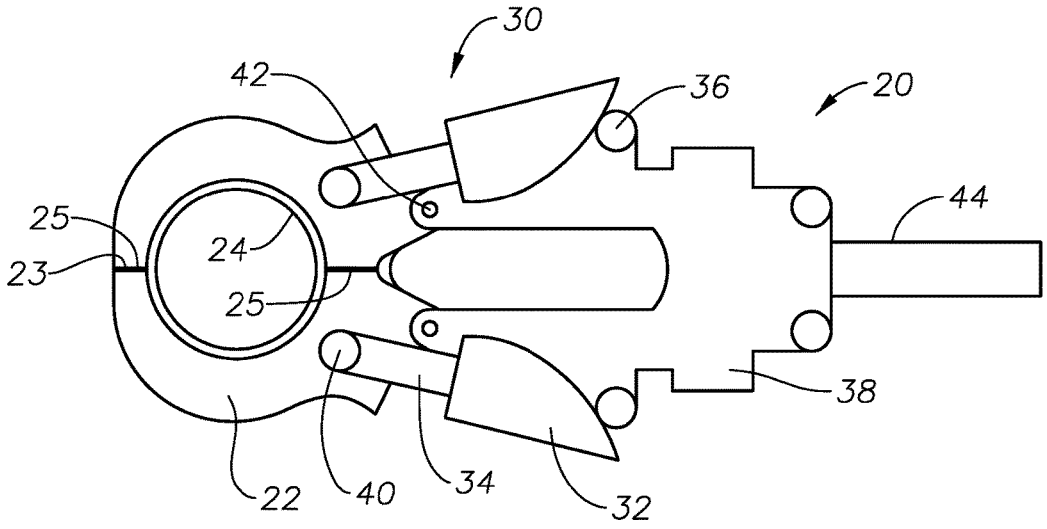
FIG. 4 is a schematic elevation view of the ram closing device of FIG. 1, shown with the rams in the closed position.

Ram assembly 20 also includes actuating arm assembly 30. Actuating arm assembly 30 is connected to at least one of the rams 22. Actuating arm assembly 30 can move ram 22 between a retracted position (FIG. 3) and an extended position (FIG. 4). When ram 22 is in the retracted position, ram closing assembly 14 is in an open position. When ram 22 is in an extended position, ram closing assembly 14 is in a closed position.

Actuating arm assembly 30 has shaped end 32 and an elbow end 34. Shaped end 32 of actuating arm assembly 30 has a shaped surface with a curved profile that engages bearing 36 of ram body 38. Elbow end 34 has elbow pin 40, which is a rotational joining member. Elbow end 34 can extend relative to shaped end 32 to move ram 22 between the retracted position and the extended position. Elbow pin 40 provides a rotational connection between elbow end 34 and ram 22. As elbow end 34 extends and moves ram 22 towards an extended position, elbow end 34 will rotate about elbow pin 40. This rotation will cause a corresponding rotation of shaped end 32, and the curved profile of shaped end 32 will roll along bearing 36.

Ram body 38 acts as a support structure for ram 22 and actuating arm assembly 30. At least one of the rams 22 pivot about pivot point 42 of ram body 38. At least one of the rams 22 is rotationally attached to ram body 38 by way of elbow pin 40 and a secondary retainer (not shown). The secondary retainer retains actuating arm assembly with ram body 38. The secondary retainer can be, for example, a pin of the actuating arm assembly 30 that travels in a track of ram body 38, a shaped profile of actuating arm assembly 30 that mates with a corresponding profile of ram body 38, an articulated join between arm assembly 30 and ram body 38, or other known connection means between an actuating assembly and a support structure.

In order to move actuating arm assembly 30 between the extended position and the retracted position, power source 44 can be used. Power source 44 can be, for example a pressurized fluid source, such as a hydraulic system, for actuating rams 22 by providing hydraulic power to actuating arm assembly 30. Power source 44 can cause the extension and retraction of actuating arm assembly 30 by extending elbow end 34 out of, or retracing elbow end 34 into, shaped end 32 as desired by an operator.

In an example of operation, during industrial operations, such as those related to hydrocarbon development and distribution, an operator might at times experience a leak or discover a potential future leak point in a fluid flow member 10, such as pipeline, flange, or a valve assembly. When this occurs, the operator can utilize ram closing assembly 14 to contain the leak so that operations can continue at full capacity.

With ram closing assembly 14 in the open position and actuating arm assembly 30 in a retracted position, an operator can guide ram closing assembly 14 from a side opposite the leak or potential leak point so that sealing chamber 16 can at least partially located around fluid flow member 10 at the location of the leak or potential leak point. When sealing chamber 16 is a segmented member, ram closing assembly 14 can be used at any location along the fluid flow member 10 that is sized such that ram closing assembly 14 can sealingly close around fluid flow member 10. When the leak is at a blind flange, valve component, or other fluid flow member with an accessible end, sealing chamber 16 can be a seamless tubular member that is sized to slide over an end of fluid flow member 10. In such an embodiment, one end of ram closing assembly 14 can have a sealing chamber that is closed at one end hand has a single ram assembly 20 at an opposite end.

Actuating arm assembly 30 is actuated with power source 44 so that it is moved to an extended position to move ram closing assembly 14 to the closed position. As an example, a pressurized fluid can be supplied to a hydraulic system of power source 44 to move ram closing assembly 14 to a closed position. As discussed above, when ram closing assembly 14 moves to a closed position, elbow end 34 extends and moves ram 22 towards an extended position, elbow end 34 will rotate about elbow pin 40. This rotation will cause a corresponding rotation of shaped end 32, and the curved profile of shaped end 32 will roll along bearing 36.

Sealing chamber 16 and rams 22 are sized to seal around the leak source of fluid flow member 10, with seals that are sized to seal around fluid flow member 10 and that are rated to contain the operating pressure of fluid flow member 10, including an appropriate safety margin. Sealing chamber 16 is large enough to contain the leak of fluid flow member 10. Ram closing assembly 14 can be used as a temporary or semi-permanent solution to the leak or potential leak, until the weak point of fluid flow member 10 can be otherwise repaired. In certain embodiments, rams 22 can optionally be kept closed and sealing around fluid flow member 10 with pins (not shown) to keep the leak isolated in case the hydraulic source that is maintaining rams 22 closed flails.

In order to remove ram closing assembly 14 from fluid flow member 10, power source 44 cam move ram closing assembly 14 to the open position and ram closing assembly 14 can be separated from fluid flow member 10.

Systems and methods of the present disclosure described herein, therefore, are well adapted to carry out the objects and attain the ends and advantages mentioned, as well as others inherent therein. While example embodiments of the disclosure have been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A ram closing assembly for sealing around a fluid flow member, the ram closing assembly comprising:

a sealing chamber assembly having:

two or more longitudinally oriented segments sized to seal together around the fluid flow member;

a chamber seal located along mating surfaces of the two or more longitudinally oriented segments, the chamber seal positioned to form a seal between the two or more longitudinally oriented segments to form a sealed body around the fluid flow member when the ram closing assembly is in a closed position;

a chamber defined by the two or more longitudinally oriented segments and sized to contain a leak of the fluid flow member; and an outer surface portion that is a generally cylindrical shape when the ram closing assembly is in the closed position;

a ram assembly located at each of an upstream end and a downstream end of the sealing chamber assembly, the ram assembly having:

a pair of rams, each ram having an engaging surface, the engaging surface sized and shaped to seal around the fluid flow member;

an actuating arm assembly connected to one of the rams; and a ram body, the pair of rams being rotationally attached to the ram body;

where each ram assembly is separately actuable with such ram assembly's actuating arm assembly.

2. The ram closing assembly according to claim 1, further comprising a power source operable to move the actuating arm assembly between an extended position and a retracted position.

3. The ram closing assembly according to claim 1, wherein when the actuating arm assembly is in an extended position, the ram closing assembly is in the closed position, and when the actuating arm assembly is in a retracted position, the ram closing assembly is in an open position.

4. The ram closing assembly according to claim 1, wherein one of the rams is secured to the sealing chamber assembly.

5. The ram closing assembly according to claim 1, wherein when the ram closing assembly is in the closed position, the engaging surface is operable to seal against an operating pressure of the fluid flow member.

6. The ram closing assembly according to claim 1, wherein when the engaging surface is an arc shaped seal and when the ram closing assembly is in the closed position, the engaging surface seals around an outer circumference of the fluid flow member.

7. The ram closing assembly according to claim 1, wherein the ram closing assembly is a stand-alone portable unit.

8. A ram closing assembly for sealing around a fluid flow member, the ram closing assembly comprising:

a sealing chamber assembly operable to maintain a seal around an outer diameter of the fluid flow member, the sealing chamber assembly having:

two or more longitudinally oriented segments sized to seal together around the fluid flow member;

a chamber seal located along mating surfaces of the two or more longitudinally oriented segments, the chamber seal positioned to form a seal between the two or more longitudinally oriented segments to form a sealed body around the fluid flow member when the ram closing assembly is in a closed position; and a chamber defined by the two or more longitudinally oriented segments and sized to contain a leak of the fluid flow member, where the fluid flow member has a fluid flow path containing a fluid under pressure;

a ram assembly secured to each of an upstream end and a downstream end of the sealing chamber assembly, each ram assembly having:

a pair of rams, each ram having an engaging surface, the engaging surface sized and shaped to seal around the fluid flow member, wherein one of the rams of each ram assembly is connected to the sealing chamber assembly;

an actuating arm assembly connected to one of the rams and operable to move the ram between a retracted position where the ram closing assembly is in an open position and an extended position where the ram closing assembly is in the closed position; and a ram body, the one of the rams of each ram assembly being rotationally attached to the ram body; where each ram assembly is separately actuable with such ram assembly's actuating arm assembly.

9. The ram closing assembly according to claim 8, further comprising a pressurized fluid source operable to move the actuating arm assembly between the extended position and the retracted position.

10. The ram closing assembly according to claim 8, wherein the chamber seals seal against an operating pressure of the fluid flow member.

11. The ram closing assembly according to claim 8, wherein when the ram closing assembly is in the closed position, the engaging surface is operable to seal against an operating pressure of the fluid flow member.

12. The ram closing assembly according to claim 8, wherein the engaging surface is an arc shaped seal and when the ram closing assembly is in the closed position, the engaging surface seals around an outer circumference of the fluid flow member.

13. A method for sealing around a fluid flow member with a ram closing assembly, the method comprising:

circumscribing the fluid flow member with a sealing chamber assembly, the sealing chamber assembly having:

two or more longitudinally oriented segments sized to seal together around the fluid flow member;

a chamber seal located along mating surfaces of the two or more longitudinally oriented segments, the chamber seal positioned to form a seal between the two or more longitudinally oriented segments to form a sealed body around the fluid flow member when the ram closing assembly is in a closed position;

a chamber defined by the two or more longitudinally oriented segments and sized to contain a leak of the fluid flow member; and a ram assembly located at each of an upstream end and a downstream end of the sealing chamber assembly, the ram assembly having a ram body and a pair of rams rotationally attached to the ram body; and actuating the pair of rams with an actuating arm assembly of the ram assembly to move the ram closing assembly to the closed position so that an engaging surface of the rams seal around the fluid flow member, the actuating arm assembly being connected to one of the rams, where each ram assembly is separately actuable with such ram assembly's actuating arm assembly.

14. The method according to claim 13, wherein the step of actuating the pair of rams with the actuating arm assembly includes moving the actuating arm assembly between an extended position and a retracted position with a power source.

15. The method according to claim 13, wherein when the ram closing assembly is in the closed position, the engaging surface is operable to seal against an operating pressure of the fluid flow member.

16. The method according to claim 13, wherein the engaging surface is an arc shaped seal and the method further comprises sealing around an outer circumference of the fluid flow member when the ram closing assembly is in the closed position.

* * * * *